United States Patent [19]

Buechel

[11] 4,410,124

[45] Oct. 18, 1983

[54] METHOD OF MANUFACTURING A FIRING ELECTRODE

[75] Inventor: Franz Buechel, Ruggell, Liechtenstein

[73] Assignee: Hilti Aktiengesellschaft, Schaan, Liechtenstein

[21] Appl. No.: 248,306

[22] Filed: Mar. 27, 1981

[30] Foreign Application Priority Data

Mar. 31, 1980 [DE] Fed. Rep. of Germany ..... 3012497

[51] Int. Cl.[3] ..... B25C 1/14

[52] U.S. Cl. ..... 227/9; 427/126.2

[58] Field of Search ..... 42/84; 89/28 R, 135; 227/9, 10; 427/34, 126.2, 423

[56] References Cited

U.S. PATENT DOCUMENTS

| | | | |
|---|---|---|---|
| 2,934,667 | 4/1960 | Pincus | 427/126.2 X |
| 3,046,434 | 7/1962 | Schurecht | 427/126.2 X |
| 3,494,531 | 2/1970 | Seghezzi | 227/11 X |
| 3,968,303 | 7/1976 | Harris | 427/126.2 X |
| 3,992,230 | 11/1976 | Komiyama et al. | 427/126.2 X |
| 4,107,018 | 8/1978 | Bode et al. | 427/126.2 X |
| 4,146,936 | 4/1979 | Aoyagi et al. | 427/423 X |
| 4,265,930 | 5/1981 | Shinohara et al. | 427/34 |

FOREIGN PATENT DOCUMENTS

| | | | |
|---|---|---|---|
| 293229 | 9/1971 | Austria . | |
| 2362099 | 7/1974 | Fed. Rep. of Germany | 227/10 |
| 2417967 | 11/1974 | Fed. Rep. of Germany | 227/10 |

*Primary Examiner*—Paul A. Bell

[57] ABSTRACT

In a device using caseless propellent charges for driving fastening elements into a receiving material, a firing assembly is slidably mounted within the device casing. The firing assembly includes a firing member laterally enclosed by an electrically insulating material within a guidance member. The insulating material is spray-coated on the firing member.

4 Claims, 2 Drawing Figures

METHOD OF MANUFACTURING A FIRING ELECTRODE

SUMMARY OF THE INVENTION

The present invention is directed to a method of manufacturing a firing electrode for use in a device employing caseless propellent charges for driving fastening elements into a receiving material. The firing electrode is positioned within a guidance member with an electrically insulating material separating the electrode and the guidance member.

In the ignition of caseless propellent charges, in addition to known mechanical firing means, electrical firing means have also been used. The electrical energy, originating from a battery, is conducted to an electrical resistor which generates sufficient heat to ignite the propellent charge. The supply of the firing current to a charge is effected by a firing electrode. This electrode must be electrically insulated from the surrounding guidance member. To-date, this separation has been accomplished by slipping a tube of insulating material between the two members. The formation of such a tube is, however, very complicated and consequently expensive. A relatively thick-walled portion of the firing assembly is located at its end adjoining the combustion chamber and it is exposed directly to the pressure and temperature of the propellent gases generated when a charge is ignited. The stresses generated when a charge is fired tends to cause rapid wear of the insulation tube. When the insulation is not present failures to ignite and short circuits result. It is relatively complicated to replace damaged insulating tubes and it requires an extended interruption in operation of the device.

Therefore, it is the primary object of the present invention to provide a simple insulation of the firing electrode.

In accordance with the present invention, the firing electrode is coated with an electrically insulating material and then is fitted into the guidance member for the electrode.

In accordance with the present invention, the insulation is applied directly onto the firing electrode. In this way it is possible to prevent any gap between the electrode and the enclosing insulation. Fitting the coated firing electrode into the guidance member can be effected by cylindrical grinding. In this manner any play between the outer surface of the insulation and the juxtaposed surface of the guidance member can kept to a minimum. Consequently, propellent gases cannot escape from the combustion chamber in the direction along the firing electrode.

The thickness of the insulation layer on the electrode should be as uniform as possible. Accordingly, it is advantageous to apply the insulation layer by spray-coating. Spray-coating the insulation material onto the electrode while it rotates about its axis makes it possible to deposit a relatively thin layer.

To provide a uniform coating of the electrode with optimum insulation characteristics, it is necessary that the material to be spray-coated is completely melted with a dense sprayed structure being accomplished. To achieve the melting temperatures which are high in certain materials, it is advantageous when spray-coating is carried out by means of a plasma jet.

Basically, different materials may be used for coating the electrode. Because of the high pressures and high temperatures which occur in the region of the combustion chamber, it is advantageous if the coating is formed by a ceramic material. Ceramic materials have a very high melting point and, therefore, are appropriately resistant to the conditions occurring in the combustion chamber.

Since the insulation is applied directly to the firing electrode, a relatively thin layer is sufficient. Accordingly, it is adequate if the thickness of the electrically insulating material is in the range of 0.2 to 0.5 mm, and preferably if it is 0.3 mm. To assure a uniform thickness of the insulating layer, the electrode can be finished after coating, such as by grinding.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2:
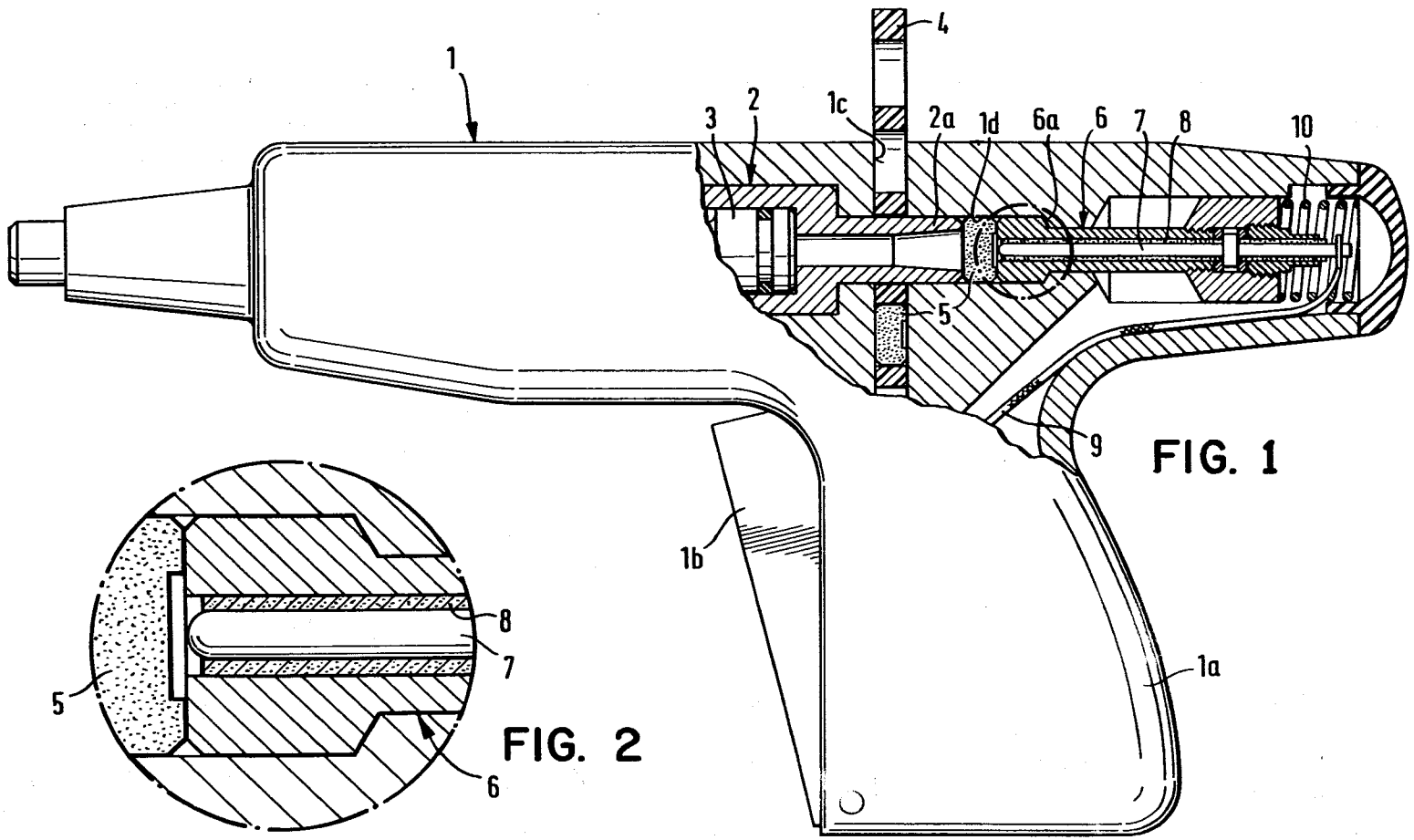
FIG. 1 is a side elevational view, partly in section, of a fastening element setting device powered by a propellent charge which is ignited by a firing electrode.
FIG. 2 is an enlarged detail view of the encircled portion of the device shown in FIG. 1.

As shown in the drawing, the fastening element device includes a handgun-shaped casing 1 having a handle 1*a* adjacent one end. The casing 1 has a front end, the left end as viewed in the drawing, and an oppositely directed rear end. Fastening elements are driven out of the front end of the casing. A trigger 1*b* is located in the handle 1*a* for actuating the device. A barrel 2 is located within and extends in the front end-rear end direction in the casing 1. A percussion piston 3 is movably mounted in the barrel 2 for driving fastening elements out of the device. The rear end of the barrel 2 has a reduced diameter feed element 2*a*. The casing 1 has a magazine channel 1*c* extending transversely of the axial direction of the barrel. A magazine 4 is positioned in the magazine channel 1*c*. Magazine 4 has spaced recesses containing caseless propellent charges 5. As illustrated in the drawing, during operation of the device, the feed element 2*a* of the barrel 2 moves rearwardly through the magazine 4 displacing a caseless propellent charge 5 out of the recess in the magazine into a combustion chamber 1*d* in the casing. In addition to the casing, the combustion chamber 1*d* is bounded on the front side by the rear end of the feed element 2*a* and on the rear side by the front end of an electrode assembly. The electrode assembly includes a tubular shaped guidance member 6 slidably supported in the casing 1 for movement in the axial direction of the barrel, that is, in the front end-rear end direction. Centrally positioned within the guidance member 6 is an axially elongated firing electrode 7. The firing electrode 7 is spaced radially inwardly from the inside surface of the electrode guidance member 6 and an annular layer of electrically insulating material 8 fills the space between the firing electrode and the guidance member. The jacket or annular layer of the insulation material 8 prevents short circuits between the firing electrode 7 and its guidance member 6. The arrangement of the coating or layer of insulating material 8 can be seen more clearly in the enlarged view in FIG. 2 illustrating the front end of the electrode assembly. Wire 9 is connected to the rear end of the firing electrode 7 and supplies current to the electrode. Guidance member 6 is axially slidable within the casing and is biased by a spring 10 toward the magazine 4, that is, toward the front end of the casing. When the fastening element setting device is pressed against a receiving material into which a fastening element is to be driven, the barrel is pressed in the axial direction inwardly into the casing so that the feed element 2*a* at the rear end of the barrel displaces a caseless propellent charge out of the magazine 4 into the combustion chamber 1*d*. Rearward movement of the barrel causes the guidance member 6 to be moved rearwardly against the biasing action of the spring 10. By pressing the trigger 1*b* current can be supplied to the electrode 7 for firing the caseless propellent charge 5 within the combustion chamber 1*d*. If the charge 5 fails to ignite, when the device is removed from the receiving material, the spring 10 moves the guidance member 6 toward the front end of the casing so that the charge which has not been ignited or has only been partially ignited, is returned into the corresponding recess in the magazine.

As can be seen in the drawing, the front end portion of the guidance member 6 has a larger diameter than the rear end portion. The casing is comparably dimensioned to receive these two different diameters so that a shoulder 6*a* formed on the rear end of the larger diameter portion of the guidance member interacts with a corresponding shoulder formed in the casing forming a stop for rearward movement of the guidance member. Further, the interaction of these two shoulders with the comparable dimensioning of the guidance member and the casing makes it possible to seal the rear side of the combustion chamber 1*d*. The difference in diameters of the guidance member is made possible especially due to the limited wall thickness of the layer of insulating material 8. The firing electrode 7 with its laterally enclosing layer of insulation material 8 is fitted in close engagement within the guidance member 6. As a result, there is no gap presented between the insulating material and the inside surface of the guidance member 6 so that a seal is effected preventing any rearward flow of gases generated in the combustion chamber.

The layer of insulating material 8 is directly deposited on the outside surface of the firing electrode 7, preferably by spray-coating. The spray-coating operation is carried out while the electrode is rotated about its axis so that a relatively thin layer of insulating material can be formed around the electrode.

Preferably, the insulating material 8 is completely melted and then spray-coated onto the electrode so that a dense structure is provided. Advantageously, the spray-coating is carried out by a plasma jet. It is further advantageous if a ceramic material is used as the insulating material so that it is able to withstand both the high pressures and high temperatures generated within the combustion chamber when a caseless propellent charge is ignited. Due to the spray-coating of the insulating material 8 on the electrode 7, a uniform thin annular layer of the insulating material can be deposited with a thickness in the range of 0.2 to 0.5 mm, and preferably about 0.3 mm. After the layer of insulating material 8 is deposited on the electrode, the outside surface of the insulating material can be finished such as by grinding so that the finished outside diameter is such that a sealing contact is provided between the outside surface of the insulating material and the inside surface of the guidance member 6 into which the finished coated electrode is inserted.

While specific embodiments of the invention have been shown and described in detail to illustrate the application of the inventive principles, it will be understood that the invention may be embodied otherwise without departing from such principles.

I claim:

1. An explosive powder driven device utilizing caseless propellent charges for driving fastening elements into a receiving material comprising a casing having a front end from which the fastening elements are driven and a rear end, a barrel slidably mounted within said casing, a propelling piston movably displaceable within said barrel, a propellent charge firing assembly slidably mounted with said casing and located in alignment with said barrel in the front end-rear end direction of said casing with said assembly being located between said barrel and the rear end of said casing, said casing, barrel and firing assembly combining to form a combustion chamber, said firing assembly comprising an axially extending firing electrode for igniting a propellent charge positioned within said combustion chamber, a tubular guidance member laterally enclosing said firing electrode with said firing electrode being in spaced relation inwardly from said guidance member, said guidance member being axially displaceable relative to said casing and a spray-coated annular layer of electrically insulating material directly deposited on the axially extending surface of said firing electrode so that there is no gap between said insulating material and the axially extending surface of said firing electrode and the space between said firing electrode and said guidance member is completely filled with the radially outer surface of said electrically insulating material annular layer begin in sealing contact with the juxtaposed surface of said guidance member.

2. An explosive powder driven device, as set forth in claim 1, wherein said electrically insulating material annular layer on said firing electrode having a thickness in the range of 0.2 to 0.5 mm.

3. An explosive powder driven device, as set forth in claim 2, wherein said electrically insulating material annular layer having a thickness of 0.3 mm.

4. An explosive powder driven device, as set forth in claim 1, wherein said guidance member being shaped to fit in sealing contact with the juxtaposed surface of said casing when a propellent charge is located within said combustion chamber.

* * * * *